United States Patent [19]

Niederprüm et al.

[11] 4,006,064

[45] Feb. 1, 1977

[54] PROCESS FOR THE ELECTRODEPOSITION OF CHROME PLATE USING FLUORINE-CONTAINING WETTING AGENTS

[75] Inventors: Hans Niederprüm, Monheim; Heinz Günter Klein, Cologne; Johann Nikolaus Meussdoerffer, Blecher, all of Germany

[73] Assignee: Bayer Aktiengesellschaft, Leverkusen, Germany

[22] Filed: Feb. 10, 1976

[21] Appl. No.: 657,014

[30] Foreign Application Priority Data

Feb. 28, 1975 Germany ..... 2508708

[52] U.S. Cl. ..... 204/51; 204/DIG. 1

[51] Int. Cl.[2] ..... C25D 3/10

[58] Field of Search ..... 204/51, 43 R, DIG. 1, 204/44, 105

[56] References Cited

UNITED STATES PATENTS

| | | | |
|---|---|---|---|
| 2,750,335 | 6/1956 | Brown et al. | 204/51 |
| 2,846,380 | 8/1958 | Brown | 204/51 |
| 3,432,408 | 3/1969 | Brown et al. | 204/51 |
| 3,476,753 | 11/1969 | Hansen | 204/51 X |

*Primary Examiner*—G. L. Kaplan

*Attorney, Agent, or Firm*—Burgess, Dinklage & Sprung

[57] ABSTRACT

In the electrodeposition of a chrome layer wherein the chrome is deposited from an electrolyte solution containing a hexavalent chromium compound in the presence of a fluorine-based surfactant, the improvement which comprises employing as the fluorine-based surfactant a quaternary ammonium perfluoralkane sulfonate of the formula $$[R_FSO_3]^- [NR^1R^2R^3R^4]^+$$

in which $R^1$,$R^2$, $R^3$ and $R^4$ each individually is alkyl, alkenyl, cycloalkyl or aralkyl of up to 18 carbon atoms, or two or three of $R^1$, $R^2$, $R^3$ and $R^4$ together with the nitrogen atom to which they are attached form a heterocyclic ring, and $R_F$ is a perfluorinated alkyl radical with 6 to 12 carbon atoms.

Additives such as $Na_2CO_3$, $NaHCO_3$, $Na_2CrO_4$, $K_2CrO_4$, $Na_2Cr_2O_7$ and $K_2Cr_2O_7$ or water may also be admixed with the quaternary ammonium perfluoralkane sulfonate.

10 Claims, No Drawings

PROCESS FOR THE ELECTRODEPOSITION OF CHROME PLATE USING FLUORINE-CONTAINING WETTING AGENTS

In the electrodeposition of chrome plate from hexavalent Cr-electrolytes, the vigorous evolution of hydrogen at the cathode and, to a lesser extent, the evolution of oxygen at the anode results in the formation of spray mists containing chromic acid which have a highly corrosive effect and can contaminate other surface treatment baths in the vicinity of a chrome-plating installation. Furthermore, on account of the toxic properties of hexavalent chromium these spray mists are physiologically unacceptable. It is particularly the last of these disadvantages which, in the course of efforts to protect the environment, has prompted numerous investigations into ways and means of suppressing the formation of spray mists during the electrodeposition of chrome plate or of effectively eliminating the mists formed. In the latter case, elaborate extraction systems are required for recovering the spray losses which amount to as much as 5 to 10% of the $CrO_3$-consumption (cf. R. Weiner, Die galvanische Verchromung, Leuz-Verlag Saulgau/Wurtt, 1974, page 13, 192). The formation of spray mists may be reduced for example by introducing small hollow plastic beads on to the surface of the bath.

Another method adopted in practice for alleviating the difficulties referred to above is to use wetting agents which are resistant both to chromic acid and to anodic oxidation and which, on the one hand, reduce the surface tension of the highly viscous electrolyte solution, thereby greatly reducing entrainment losses, especially in bright chrome plating with its short exposure times, and on the other hand form a dense covering of foam which effectively prevents the droplets of chromic acid entrained by the hydrogen from escaping. By virtue of their high chemical and thermal stability, fluorine surfactants have proved to be particularly suitable for this purpose, for example in accordance with German Patent Specifications Nos. 937,210 and 939,611, cf. also C. G. Klaus, Chem. Age 77 (1957), 883; Belgian Pat. No. 814,801. Salts of perfluoralkane sulfonic acids, more especially the potassium salts of perfluoroctane sulfonic acid, are primarily used in practice. Unfortunately, the potassium salt of perfluoroctane sulfonic acid is substantially insoluble in water (approximately 2 g/l). In concentrated acids, such as aqueous chromic acid, its solubility is even lower. However, our own investigations have shown that the maximum reduction in surface tension amounts to approximately 23 dyn/cm (in water at 25° C) for a concentration of 4 g/l (with sediment). The reason why it is only supersaturated solutions of $C_8F_{17}SO_3K$ which reduce surface tension to the maximum extent is that the manufacturing method of electrochemical fluorination results in the formation of isomer mixtures of straight-chain and branched perfluoralkane sulfonyl compounds (cf. for example German Offenlegungsschrift No. 2,238,152), the branched isomers being more soluble in water.

Unfortunately, conventional wetting agents also give rise to disadvantages when used in baths for the electro-deposition of chrome plate. Thus, their use is not recommended for the deposition of relatively thick, commercial-grade chrome layers with thicknesses of more than 15 microns, for example in hard chrome plating, because pores can be formed (resulting in inadequate protection against corrosion), cf. H. Dettner, Galvanotechnik 63 (1972), page 188, and Handbuch der Galvanotechnik, Vol. II, (1966), pages 225, 241, C. Hanser Verlag, Munich. On account of their inadequate solubility in electrolytes, there are also limits to the manner in which these agents are added for the suppression of chromic acid mists. Undissolved particles can be incorporated in the Cr-deposit where they give rise to roughness. Finally, it is not always possible to suppress the formation of chromic acid mists in hard chrome plating on account of the high current densities involved.

Accordingly, the present invention provides a process for the production of electrodeposited metal layers, more especially hard and bright chrome layers, from electrolyte solutions containing hexavalent chromium compounds using fluorine-based surfactants, which is characterized by the fact that quaternized ammonium perfluoralkane sulfonates are added as the fluorine-based surfactant.

It has surprisingly been found that the disadvantages of conventional products can be obviated by using fluorine-based surfactants corresponding to the general formula $$[R^1R^2R^3R^4N]^+ R_FSO_3^-,$$

in which $R^1$, $R^2$, $R^3$ and $R^4$ each individually is alkyl, alkenyl, cycloalkyl or aralkyl of up to 18 carbon atoms, or two or three of $R^1$, $R^2$, $R^3$ and $R^4$ together with the nitrogen atom to which they are attached form a heterocyclic ring, and $R_F$ is a perfluorinated alkyl radical with 6 to 12 carbon atoms, in the electrodeposition of chrome plate.

These quaternary ammonium perfluoralkane sulfonates are obtained by reacting perfluoralkane sulfonyl fluorides with tertiary amines and with silicic acid esters, cf. German Offenlegungsschrift No. 1,929,655 and Ann. 731, 58 – 66 (1970). By virtue of this method of production, the products according to the invention only contain extremely small quantities of fluoride ions (for example less than 0.005% of F) and other impurities, because the inorganic fluoride liberated during the reaction escapes in the form of readily volatile silicon-fluorine compounds. Apart from the fact that the purity of surfactants is of considerable significance in the production of optimum surface-tension effects (cf. K. J. Mysels and A. T. Florence, Journal of Colloid and Interface Science, Vol. 43, No. 3 (1973), page 577, and I. Kloubek and A. W. Neumann, Tenside 6 (1969), 1, 4/10), fluoride ions play an important part as catalysts in various types of baths in the electrodeposition of chrome plate, cf. R. Weiner, loc. cit., page 46. In cases where the fluorine-based surfactants according to the invention are used, their high purity avoids any uncontrolled input of fluoride ions. In contrast, other commercially available fluorine-based wetting agents have a considerably greater fluoride ion content, for example 0.15% of F, because, in the hydrolysis of the perfluoralkane sulfonyl fluorides with potassium hydroxide for example, it is not possible completely to separate the perfluoralkane sulfonates from the potassium fluoride which is also formed.

The following are examples of compounds suitable for use in accordance with the invention: tetramethyl ammonium perfluoroctane sulfonate, tetraethyl ammonium perfluorheptane sulfonate, N-methyl pyridinium perfluordecane sulfonate, N-dimethyl morpholinium perfluoroctane sulfonate and trimethyl octyl ammonium perfluorhexane sulfonate.

It is preferred to use the derivatives with short C-chains in the cation, for example $(C_2H_5)_4N^+ R_FSO_3^-$, and with 8 carbon atoms in the perfluorinated carbon radical.

One typical method of preparing tetraethyl ammonium perfluoroctane sulfonate for example is described in the following:

750 ml of chlorobenzene, 0.5 mole of perfluoroctane sulfonyl fluoride, 0.53 mole of triethyl amine and 0.175 mole of triethoxy methyl silane are mixed and the resulting mixture is heated with stirring for 1 hour at 100° C, gaseous methyl trifluorosilane being evolved. After the evolution of gas has ceased, the reaction mixture is cooled with stirring to room temperature, as a result of which the compound $(C_2H_5)_4N^+ C_8F_{17}SO_3^-$ crystallizes out.

The solubility of the product in water amounts to more than 100 g per 100 g of $H_2O$, in other words is higher by powers of 10 than the solubility of conventionally used fluorine-based surfactants, for example $C_8F_{17}SO_3K$. The maximum surface-tension reductions amount to 22.6 dyn/cm (in water at 25° C) for a very small input of only 0.72 g/l. The maximum reduction in the surface tension of a commercial-grade chromic acid solution (250 g/l of $CRO_3$, 1% of $H_2SO_4$, 50° C) to approximately 20 dyn/cm is obtained with quantities of only 0.1 to 0.15 g/l.

In addition to their high solubility, their extreme purity and the minimum input required to obtain a reduction in surface tension to almost 20 dyn/cm and to form a dense layer of foam in commercial-grade chromic acid electrolytes, the products suitable for use in accordance with the invention are surprisingly characterized by the fact that even relatively thick layers of chrome can be deposited without any danger of pore formation. Since hard chrome plating is playing an increasingly more significant role in electroplating, the process according to the invention affords considerable advantages.

The concentration of the tetraalkyl ammonium perfluoralkane sulfonates used for the electrodeposition of chrome plate generally amounts to about 10 to 300 mg/l and preferably to about 50 to 150 mg/l. With high current densities and in stirred baths, the concentration required to obtain a dense layer of foam effectively preventing chromic acid mists from escaping is at the upper limit of the specified range.

Finally, it is also surprising that the products used in accordance with the invention, in the form of organic nitrogen compounds, are resistant both to chromic acid and to anodic oxidation. Any replenishment of the additive which is necessary is essentially a function of the entrainment losses. By virtue of the considerable effectiveness of these fluorine-based surfactants, it is advisable, in order to improve their dosability, to use the products in admixture with inert substances which do not interfere with the electro-deposition process, for example soda, sodium hydrogen carbonate, sodium chromate, sodium dichromate, potassium chromate or potassium dichromate, or to use an aqueous solution.

The baths used in the process according to the invention are the bright and hard chrome baths commonly used for the electrodeposition of chrome plate (cf. for example B. R. Weiner, Die galvanische Verchromung, Leuze Verlag Saulgau/Wurtt, 1974, pages 15, 16).

In general, baths of this kind contain:

1. (Chromium(VI)oxide = $CrO_3$ the concentration of which may vary within wide limits. $CrO_3$-concentrations of about 200 g/l to 400 g/l are normally preferred.
2. Catalysts (foreign ions) such as sulfate, fluoride, silicofluoride and mixtures thereof which are responsible for the actual deposition of chrome.

The most frequently used catalyst is sulfate which is generally added in such quantities that the weight ratio of $CrO_3$ to $SO_4$ amounts to between about 120:1 and 80:1. Instead of or in addition to sulfate, chrome baths also contain additions of fluoride or silicofluoride ions. The most favorable concentration of fluoride ions amounts to between about 1.5 and 2.5%, while the most favorable concentration of silico-fluoride ions amounts to between about 1.2 and 4%, based on the $CrO_3$-content. The foreign ions may also be present in chrome baths in the form of substantially insoluble salts, for example $SrSO_4$, $K_2SiF_6$ (SRHS-baths — Self-Regulating High-Speed).

The process according to the invention is illustrated by the following Examples.

EXAMPLE 1

95 kg of sodium hydrogen carbonate and 5 kg of tetraethyl ammonium perfluoroctane sulfonate were pre-mixed in a drum and subsequently ground in a disc-attrition mill.

3.2 kg (1 g/l) of the fluorine surfactant mixture were added to a sulfuric acid hard chrome-plating bath (250 g/l of $CrO_3$ and 1% of $H_2SO_4$, based on $CrO_3$) with an electrolyte volume of 3200 l which was operated with agitation of the electrolyte at 45° to 55° C and at a current load of an average 12,000 Ah per day. An impervious cover of foam was formed on the surface of the bath in a more or less considerable thickness, depending upon the quantity of current used. The effectiveness of the fluorine-based wetting agent was judged on the basis of the dryness of the anode ends situated above the bath level and on the basis of spray-mist formation tested with filter paper 5 cm above the bath level on the cathodes. 9 kg of the 5% fluorine-based surfactant mixture, including the starting quantity (3.2 kg) were used over a period of 95 working days for maintaining an impervious foam cover over the surface of the hard chrome electrolyte. This corresponds to an average consumption of 80 g of mixture = 4 g of tetraethyl ammonium perfluoroctane sulfonate for 10,000 Ah or approximately 2.5 g of mixture = 0.125 g of fluorine-based wetting agent per 100 liters of electrolyte per day.

The parts hard-chrome-plated in this bath did not show any reduction in the hardness of the chrome layer. There was no evidence of any roughness, inclusions or pore formation of the kind observed where other wetting agents are used for hard chrome plating.

EXAMPLE 2

100 mg/l of tetraethyl ammonium perfluoroctane sulfonate were dissolved in 4 liters of chrome electrolyte containing 250 g/l of $CrO_3$, 5g/l of $SrSO_4$ and 14 g/l of $K_2SiF_6$. The surface tension amounted to 24 dyn.-$cm^{-1}$ at 50° C. Electrolysis was carried out with agitation of the bath at 50° to 55° C with a current density of 50 A/$dm^2$. The current load amounted to 400 Ah/day. After a load of 1000 Ah, it was not possible to measure any increase in surface tension.

EXAMPLE 3

50 mg/l of tetramethyl ammonium perfluoroctane sulfonate were dissolved in 4 liters of chrome electrolyte containing 400 g/l of $CrO_3$ and 4 g/l of $H_2SO_4$. Chrome plating was carried out with agitation of the bath at a temperature of 40° C and at a current density of 15 A/dm$^2$, a 2.5 cm thick, impervious layer of foam being formed. After a load of 1000 Ah, it was still possible to measure an impervious layer of foam 1.5 cm thick.

It will be appreciated that the instant specification and examples are set forth by way of illustration and not limitation, and that various modifications and changes may be made without departing from the spirit and scope of the present invention.

What is claimed is:

1. In the electrodeposition of a chrome layer wherein the chrome is deposited from an electrolyte solution containing a hexavalent chromium compound in the presence of a fluorine-based surfactant, the improvement which comprises employing a quaternary ammonium perfluoralkane sulfonate as the fluorine-based surfactant.

2. A process as claimed in claim 1, wherein the quaternary ammonium perfluoroalkane sulfonate has the formula $$[R_fSO_3]^- \; [NR^1R^2R^3R^4]^+$$

in which $R^1$, $R^2$, $R^3$ and $R^4$ each individually is alkyl, alkenyl, cycloalkyl or aralkyl of up to 18 carbon atoms, or two or three of $R^1$, $R^2$, $R^3$ and $R^4$ together with the nitrogen atom to which they are attached form a heterocyclic ring, and $R_F$ is a perfluorinated alkyl radical with 6 to 12 carbon atoms.

3. A process as claimed in claim 1, wherein the quaternary ammonium perfluoralkane sulfonate is mixed with at least one compound selected from the group consisting of $Na_2CO_3$, $NaHCO_3$, $Na_2CrO_4$, $K_2CrO_4$, $Na_2Cr_2O_7$, $K_2Cr_2O_7$ and water.

4. A process as claimed in claim 1, wherein the quaternary ammonium perfluoralkane sulfonate is present in the electrolyte solution in a concentration of about 10 to 300 mg/l.

5. A process as claimed in claim 1, wherein the quaternary ammonium perfluoralkane sulfonate comprises at least one of tetramethyl ammonium perfluoroctane sulfonate and tetraethyl ammonium perfluoroctane sulfonate.

6. A process as claimed in claim 5, wherein the quaternary ammonium perfluoralkane sulfonate is present in the electrolyte solution in a concentration of about 50 to 150 mg/l and wherein the quaternary ammonium perfluoroalkane sulfonate is mixed with at least one compound selected from the group consisting of $Na_2CO_3$, $NaHCO_3$, $Na_2CrO_4$, $K_2CrO_4$, $Na_2Cr_2O_7$, $K_2Cr_2O_7$ and water.

7. A process as claimed in claim 6, wherein the electrolyte contains a hexavalent chromium compound in an amount corresponding to about 200 to 400 g/l of $CrO_3$, and per 100 parts by weight of $CrO_3$ about 0.8 to 1.2 parts of $SO_4$ or about 1.5 to 2.5 parts of F or about 1.2 to 4 parts of $SiF_6$.

8. An electrolyte solution for the electrodeposition of chrome layers comprising water, a hexavalent chromium compound and a quaternary ammonium perfluoralkane sulfonate as a surfactant.

9. An electrolyte solution according to claim 8, wherein the quaternary ammonium perfluoralkane sulfonate comprises at least one of tetramethyl ammonium perfluoroctane sulfonate and tetraethyl ammonium perfluoroctane sulfonate which is present in the electrolyte solution in a concentration of about 50 to 150 mg/l, and wherein the quaternary ammonium perfluoroalkane sulfonate is mixed with at least one compound selected from the group consisting of $Na_2CO_3$, $NaHCO_3$, $Na_2CrO_4$, $K_2CrO_4$, $Na_2Cr_2O_7$, $K_2Cr_2O_7$ and water.

10. An electrolyte solution according to claim 9, wherein the electrolyte contains the hexavalent chromium compound in an amount corresponding to about 200 to 400 g/l of $CrO_3$, and per 100 parts by weight of $CrO_3$ about 0.8 to 1.2 parts of $SO_4$ or about 1.5 to 2.5 parts of F or about 1.2 to 4 parts of $SiF_6$.

* * * * *